US012359884B2

(12) United States Patent
Hebert

(10) Patent No.: US 12,359,884 B2
(45) Date of Patent: Jul. 15, 2025

(54) CALIBER SELECT MAGAZINE SYSTEM

(71) Applicant: Michael A. Hebert, Kalispell, MT (US)

(72) Inventor: Michael A. Hebert, Kalispell, MT (US)

( * ) Notice: Subject to any disclaimer, the term of this patent is extended or adjusted under 35 U.S.C. 154(b) by 0 days.

(21) Appl. No.: 18/106,611

(22) Filed: Sep. 15, 2023

(65) Prior Publication Data

US 2023/0417501 A1 Dec. 28, 2023

(51) Int. Cl.
*F41A 9/65* (2006.01)
*F41A 3/66* (2006.01)

(52) U.S. Cl.
CPC . *F41A 3/66* (2013.01); *F41A 9/65* (2013.01)

(58) Field of Classification Search
CPC ..... F41A 9/65; F41A 9/01
See application file for complete search history.

(56) References Cited

U.S. PATENT DOCUMENTS

2019/0212085 A1* 7/2019 Wilkinson ..... F41A 17/38

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

A firearm comprises a frame defining a magazine well configured to receive a first magazine type configured to receive a first cartridge caliber and to receive a second magazine type configured to receive a different second cartridge caliber. It has a magazine retention latch connected to the frame, and the latch is configured to admit and retain a magazine of the first type and to deny admission and retention of a magazine of the second type.

1 Claim, 13 Drawing Sheets

DETAIL A
SCALE 1.5 : 1

DETAIL B

SCALE 2 : 3

DETAIL C

SCALE 1 : 1

CALIBER SELECT MAGAZINE SYSTEM

CROSS-REFERENCE TO RELATED APPLICATIONS

This application claims the benefit of U.S. Provisional Patent Application No. 63/313,454, filed on Feb. 24, 2022, entitled "CALIBER SELECT MAGAZINE SYSTEM", which is hereby incorporated by reference in its entirety for all that is taught and disclosed therein.

FIELD OF THE INVENTION

The present invention relates to the field of firearms and more particularly relates to an improved ammunition magazine.

BACKGROUND AND SUMMARY

The pursuit of alternative calibers for existing modern firearms has led to overlooked safety and performance issues. The best example is ammunition development for the AR15/M16/M4 firearms. The ammunition makers' effort to provide new calibers for the firearm used existing cartridges that would not require a change in the bolt or magazine. These new calibers may only require the change of a barrel. One caliber in particular is the 300 AAC Blackout. Its parent case is the 5.56 NATO/.223 Remington. The 300 AAC Blackout is essentially a 7.62 mm bullet on a case designed for the 5.56 mm. The rest of the cartridge is nearly identical and can use the same bolt and magazine for reliable operation. It only requires the swap of a barrel to accommodate the larger caliber diameter bullet.

The problem with this is the firearm industry and the makers of magazines have not offered the user and operators of firearms a safe reliable alternative other than using existing magazines and bolts often labeled as 5.56 NATO. Because the 300 AAC blackout was derived from the smaller caliber cartridge the possibility of caliber confusion can and does exist. The 300 AAC blackout can be loaded and chamber in the smaller 5.56/0.223 barrels and the results if fired are catastrophic. The larger diameter bullet cannot travel down the smaller diameter barrel. The result is massive overpressure the barrel and firearm was not designed for and cannot handle that looks like a grenade went off. Many firearms have been destroyed and operators or bystanders injured.

The above disadvantage is addressed by a firearm that comprises a frame defining a magazine well configured to receive a first magazine type configured to receive a first cartridge caliber and to receive a second magazine type configured to receive a different second cartridge caliber. It has a magazine retention latch connected to the frame, and the latch is configured to admit and retain a magazine of the first type and to deny admission and retention of a magazine of the second type.

DETAILED DESCRIPTION OF A PREFERRED EMBODIMENT

Figure 1B:
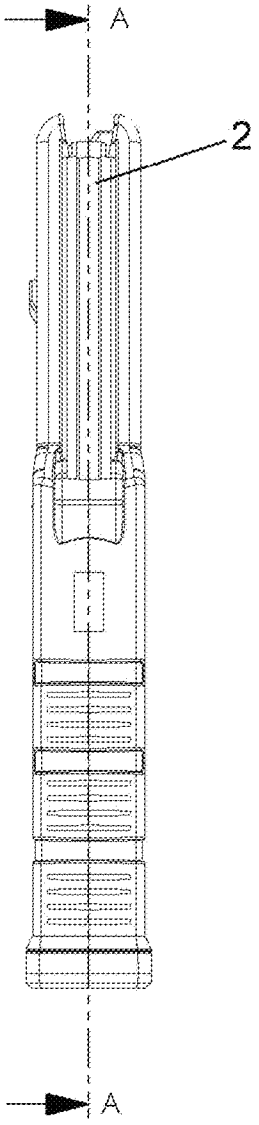
FIGS. 1A through 1C depict fully assembled views of the disclosure (magazine).
Figure 1C:
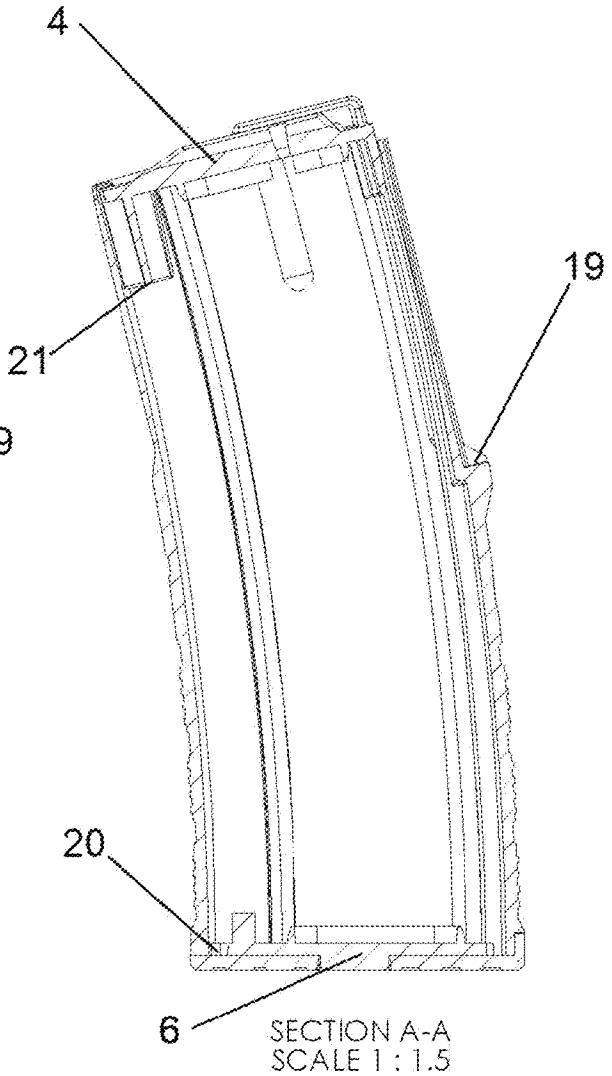
Figure 1A:
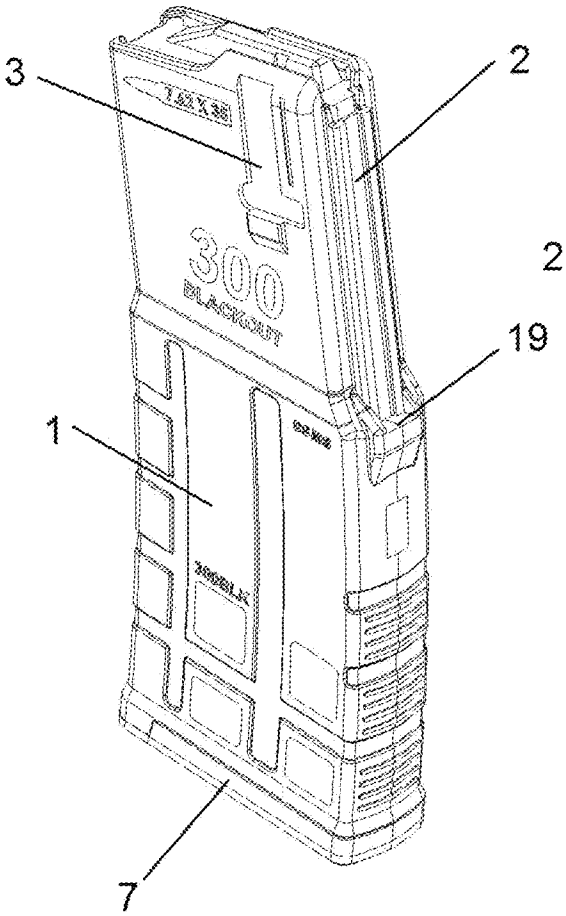
Figure 2:
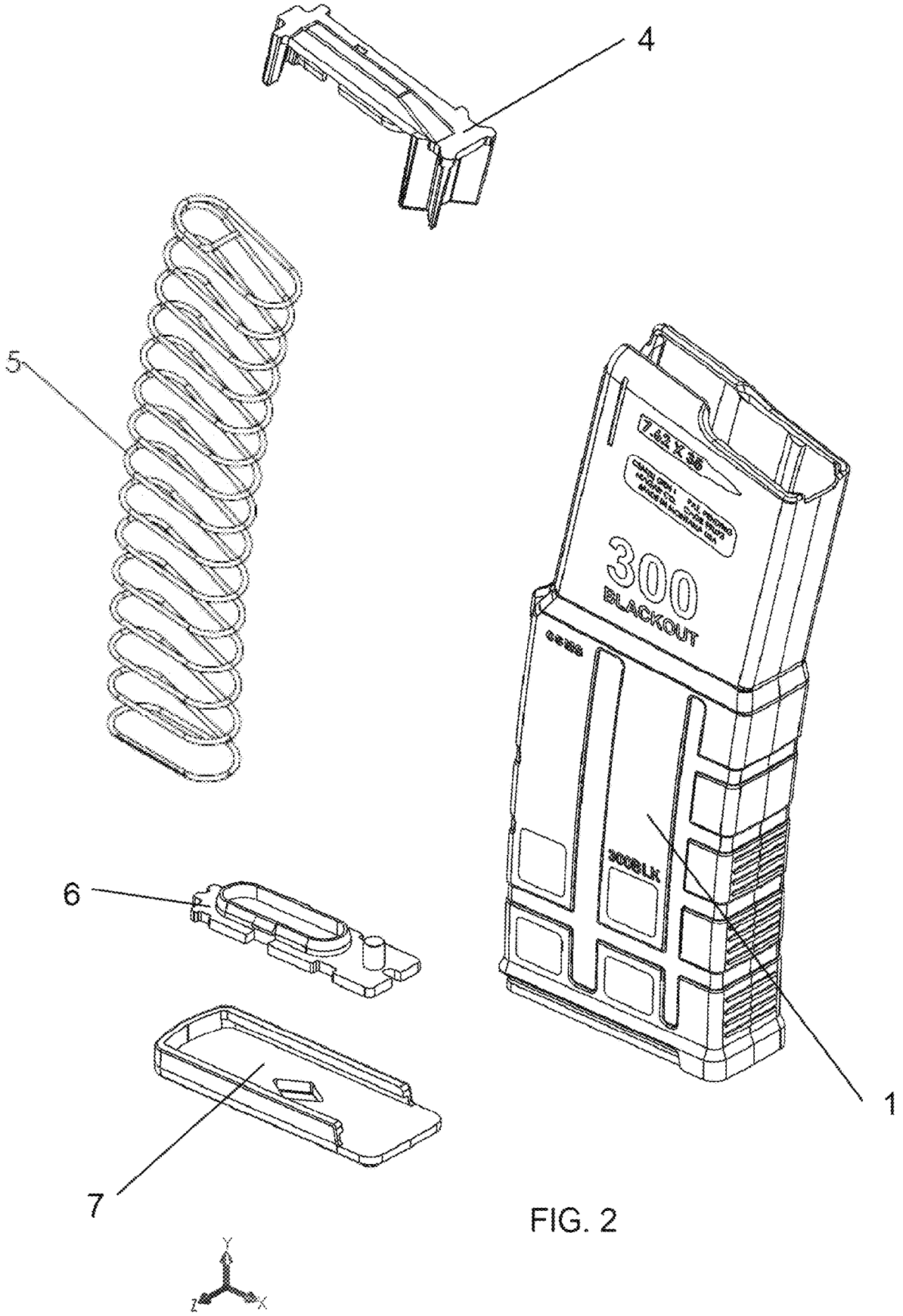
FIG. 2 depicts the magazine and its components in a disassembled state.
Figure 3B:
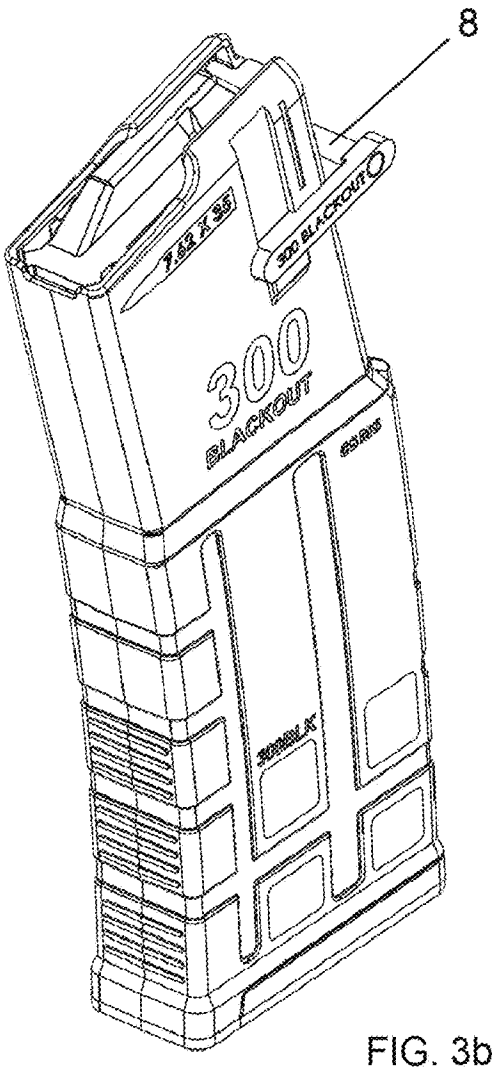
FIGS. 3A and 3B depict views of the disclosure with the magazine retention latch in place, and with the magazine retention latch removed from the body of the magazine.
Figure 3A:
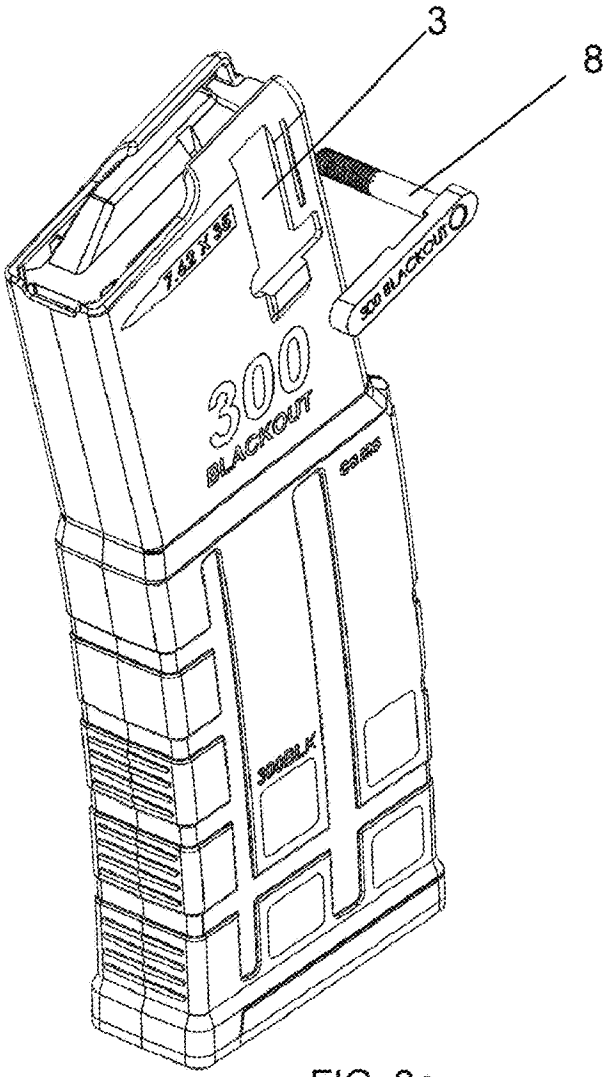
Figure 4:
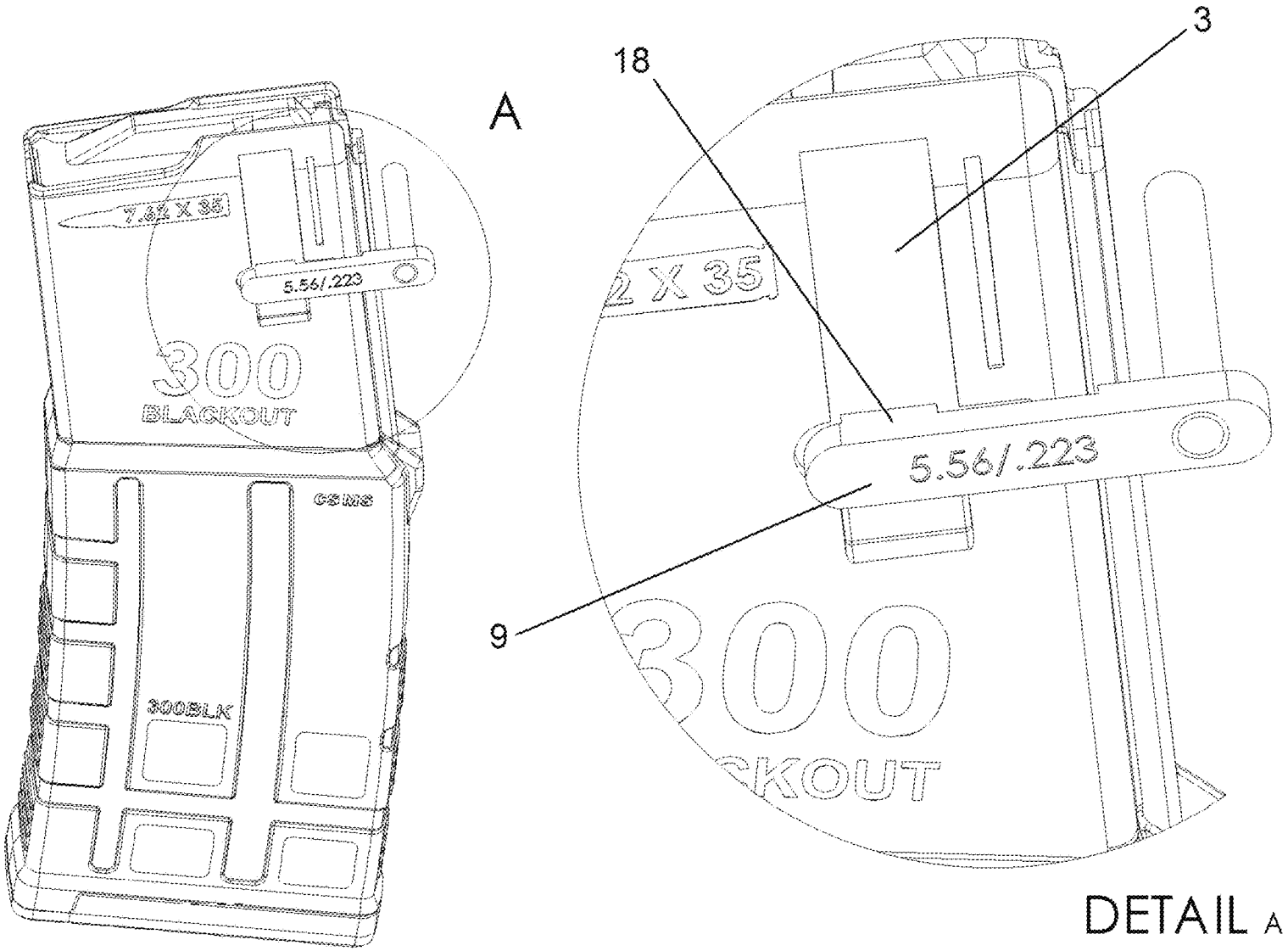
FIG. 4 depicts a close-up view of the disclosure which highlights the placement of the magazine retention latch in relation to the magazine.
Figure 5B:
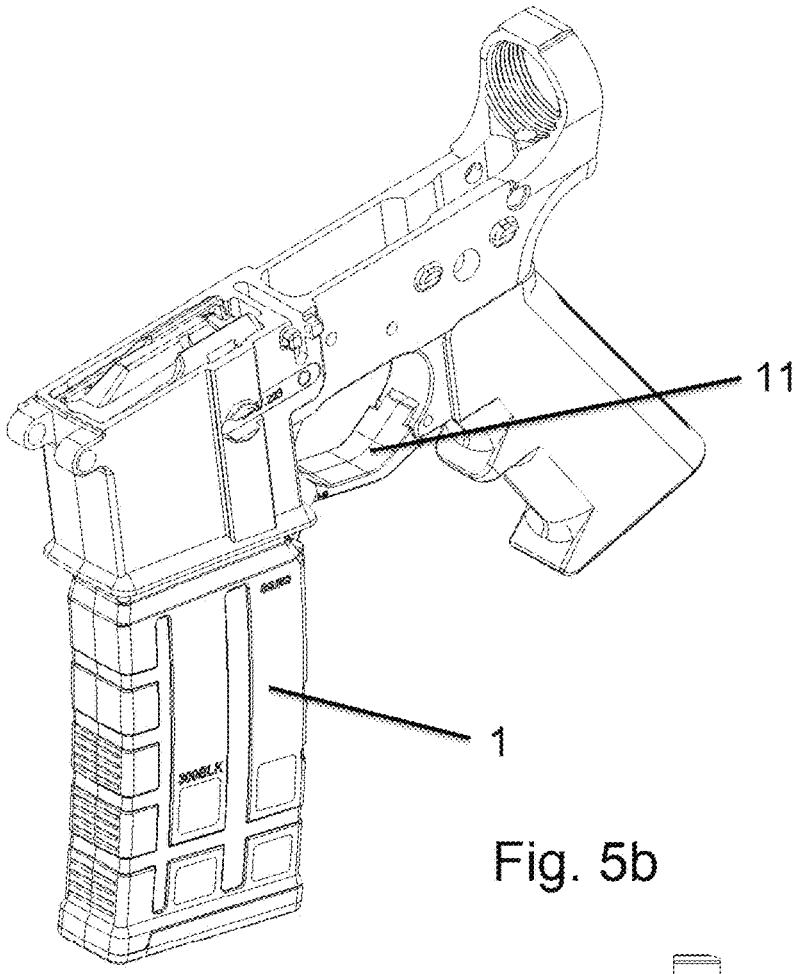
FIGS. 5A/5B and 6A/6B depict the assembled magazine, with magazine retention latch bearing the label of the designated caliber of ammunition, inserted into the lower receiver of an AR-platform rifle.
Figure 5A:
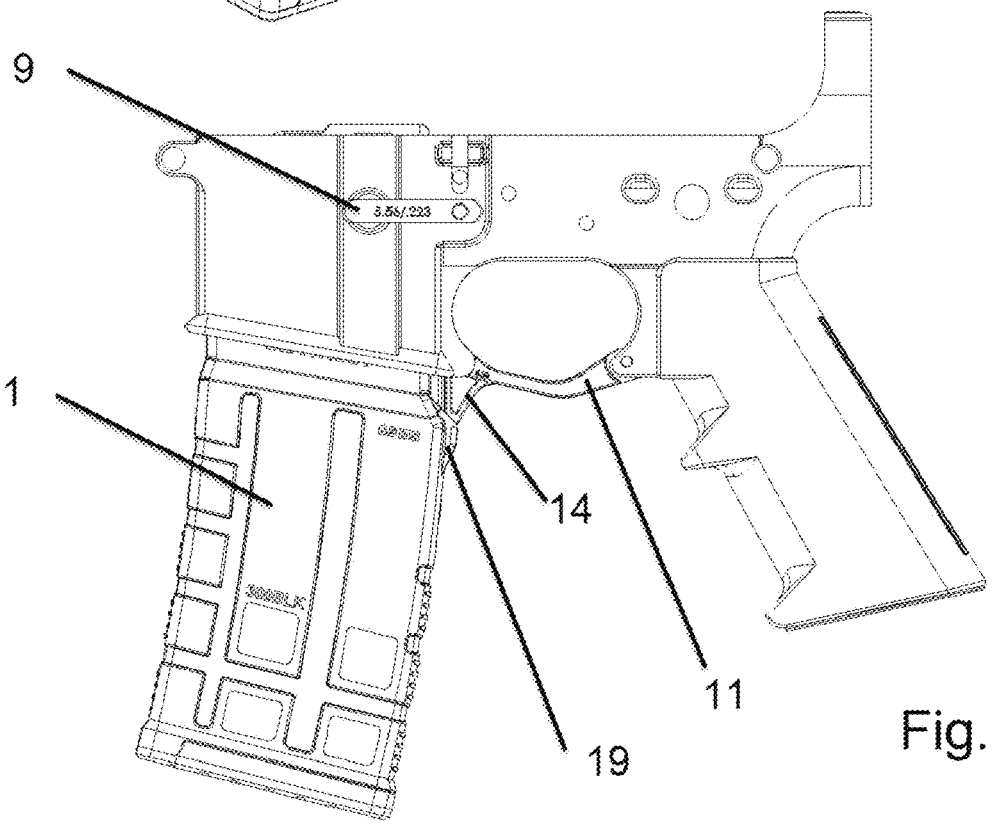
Figure 6B:
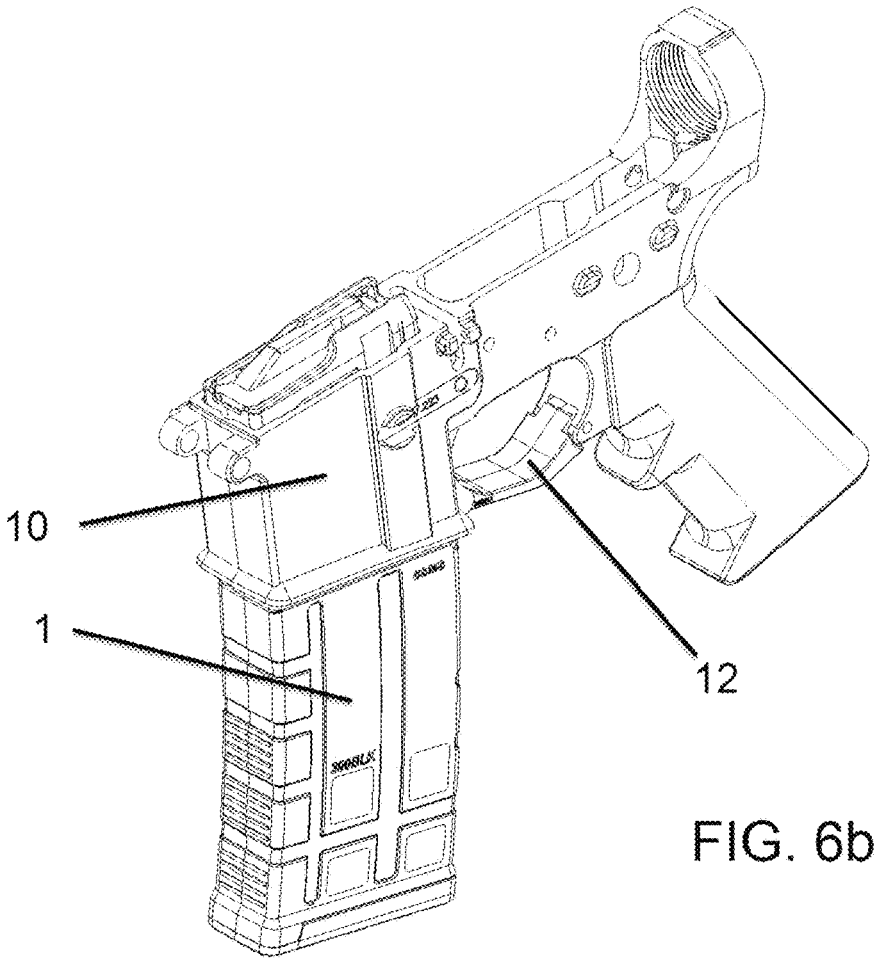
Figure 6A:
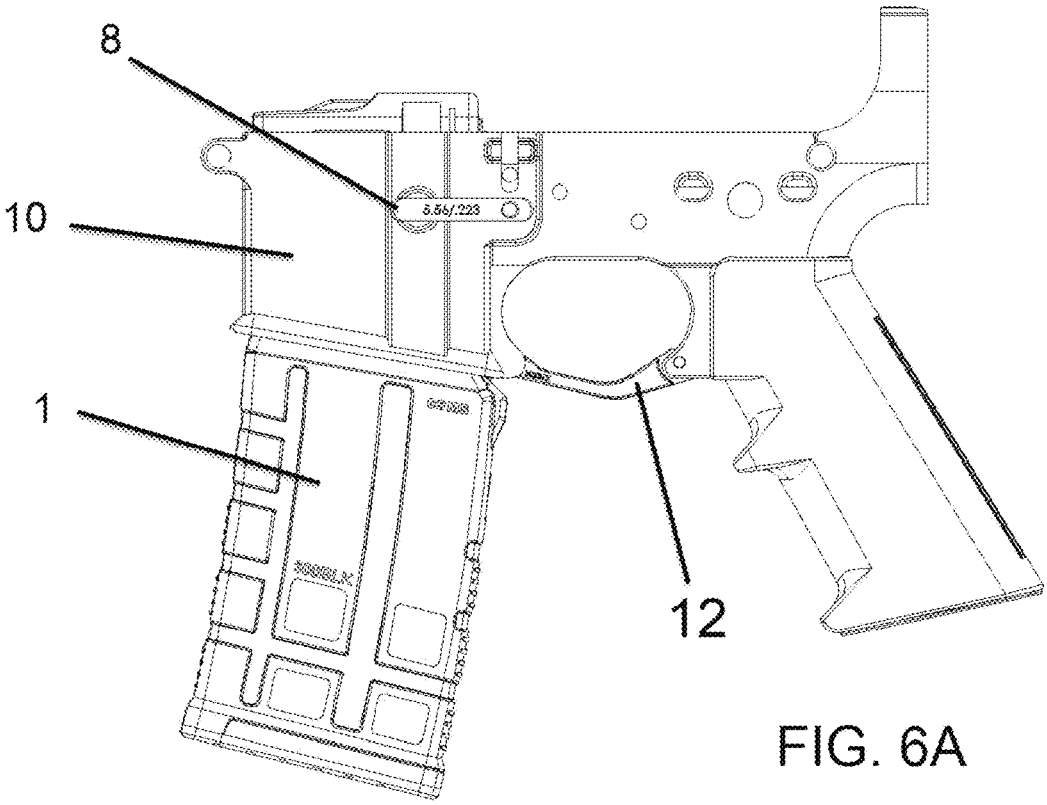
Figure 7B:
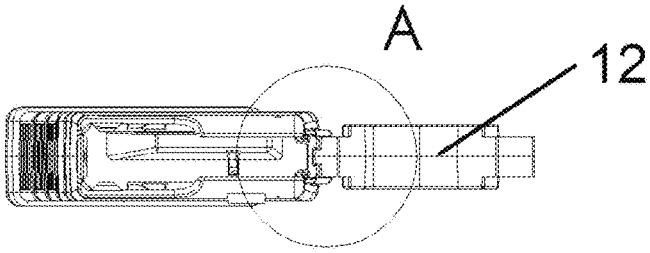
Figure 7A:
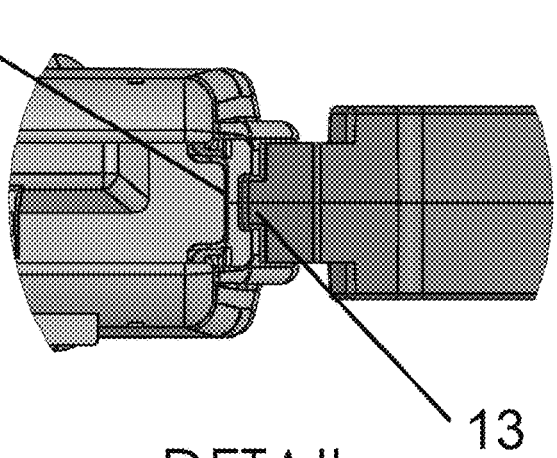
Figure 7A:
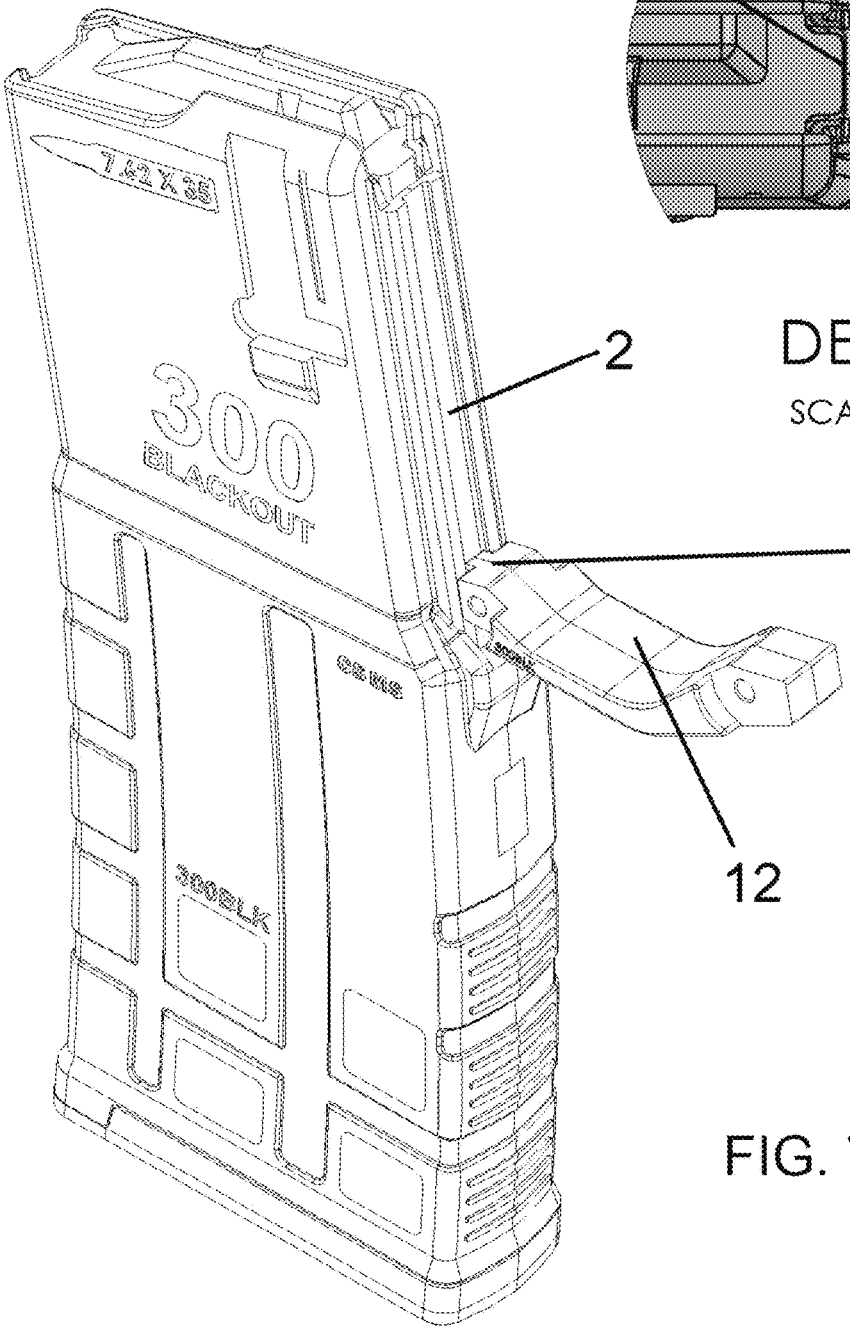
Figure 8B:
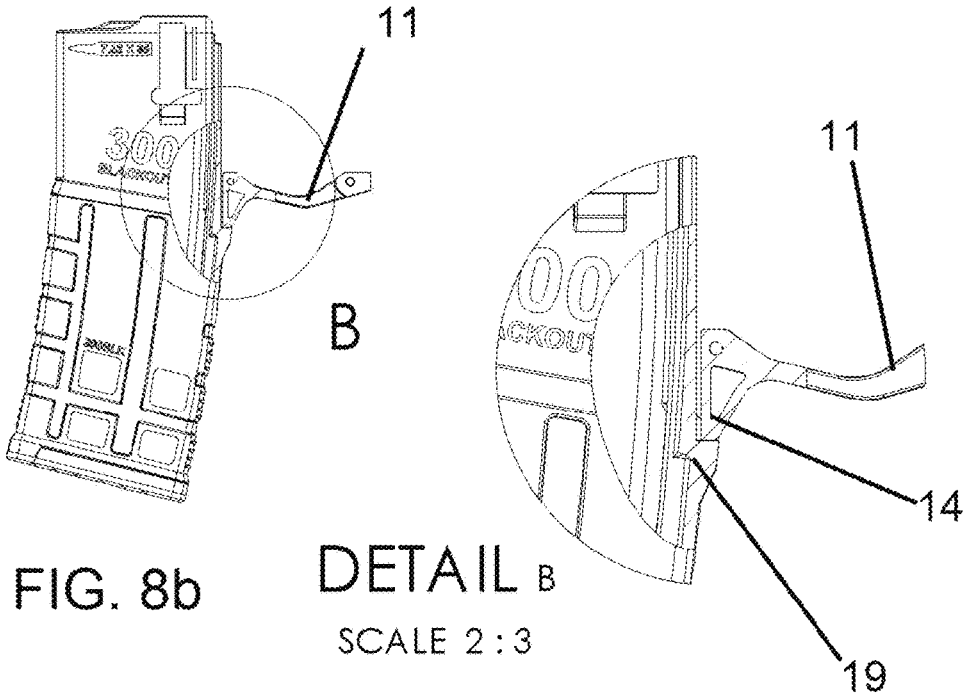
FIGS. 8A and 8B depict views of the disclosure relating to how it interfaces with the trigger guard of an AR-platform rifle.
Figure 8A:
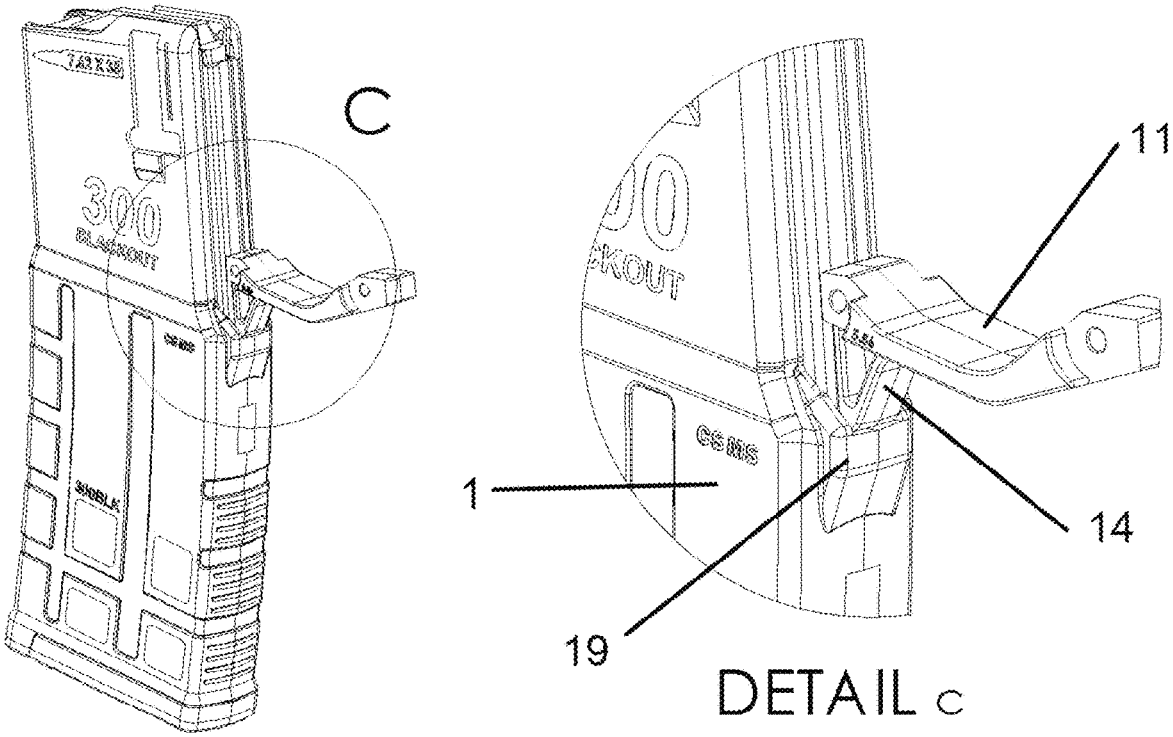
Figure 9B:
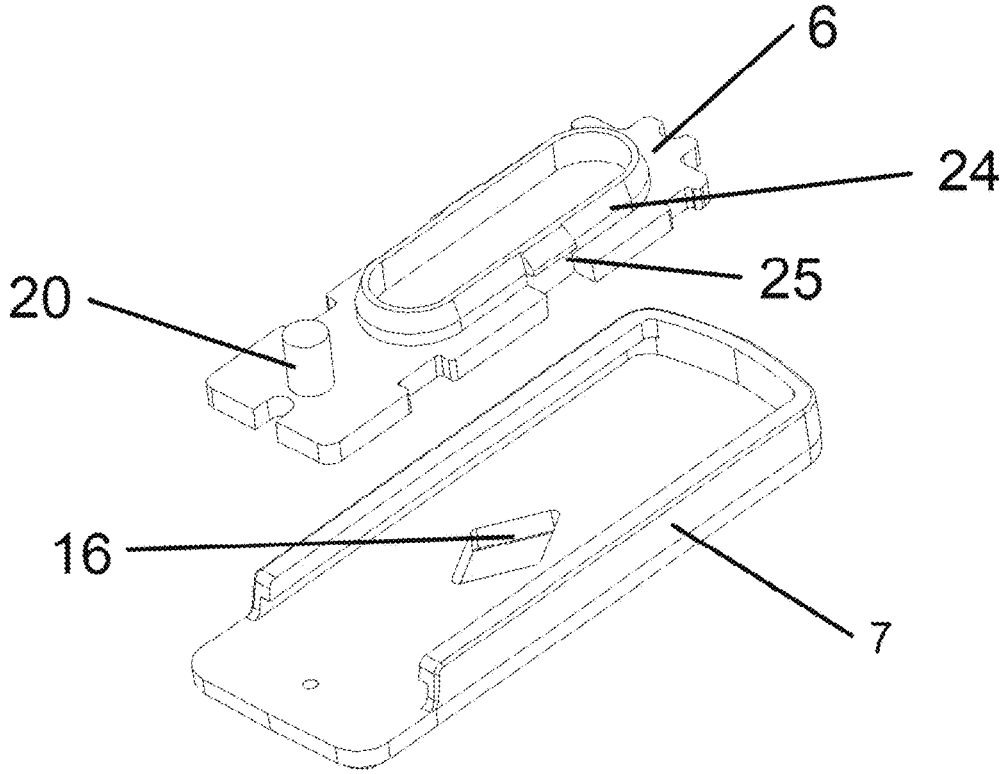
FIGS. 9A and 9B depict a disassembled view of the magazine's floor plate and floor plate retainer.
Figure 9A:
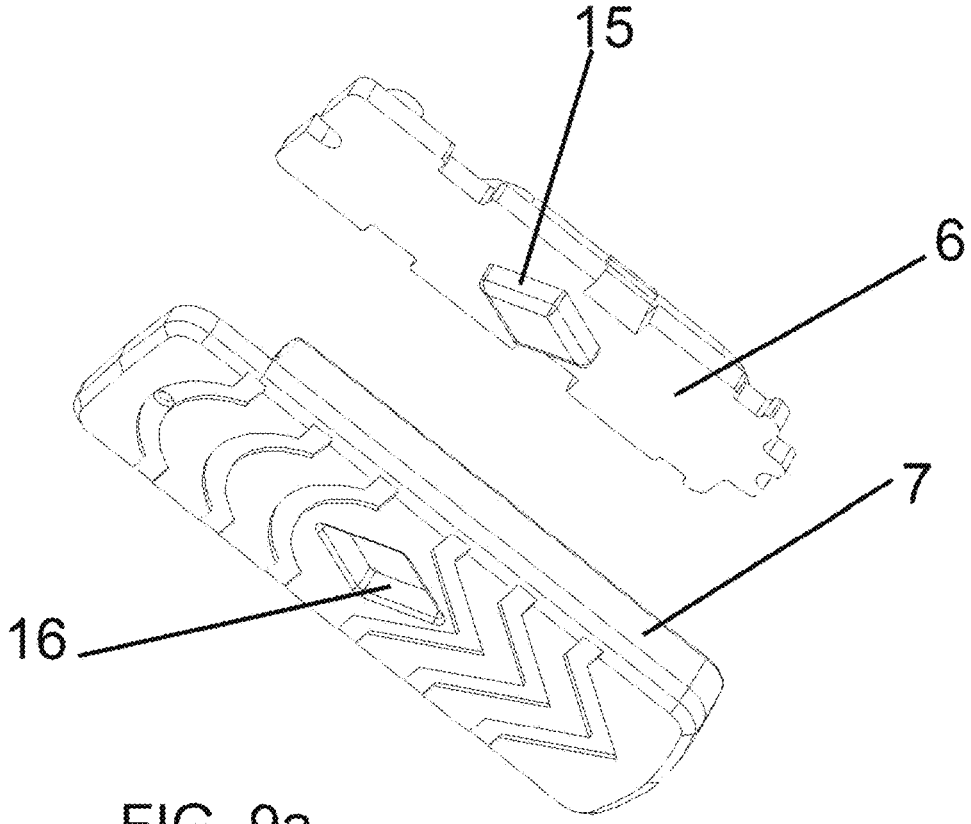
Figure 10C:
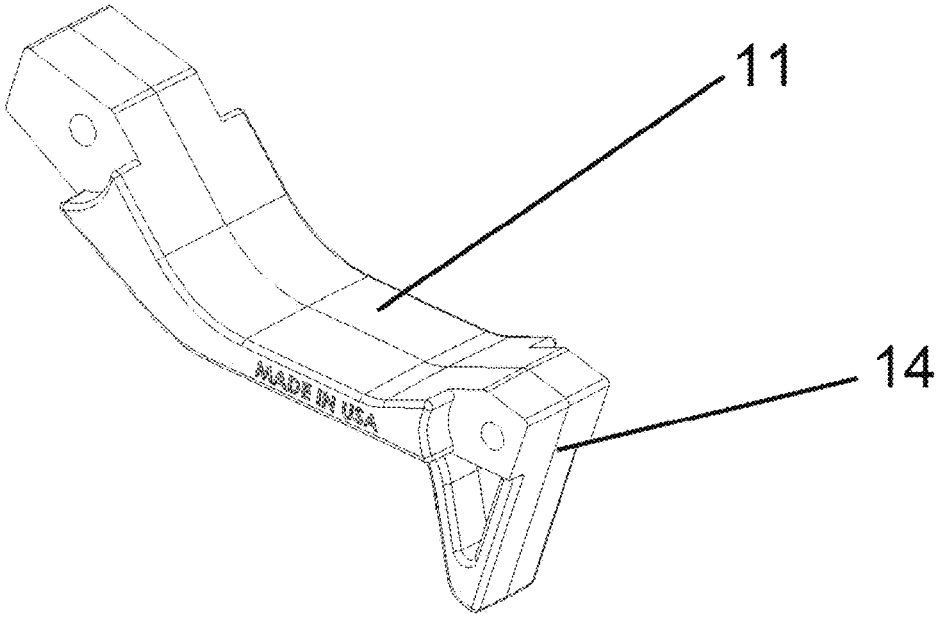
FIGS. 10A, 10B, and 10C depict views of a trigger guard for an AR-platform rifle.
Figure 10B:
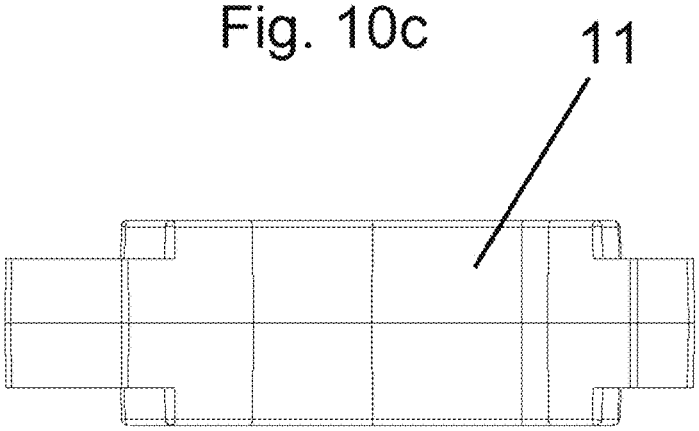
Figure 10A:
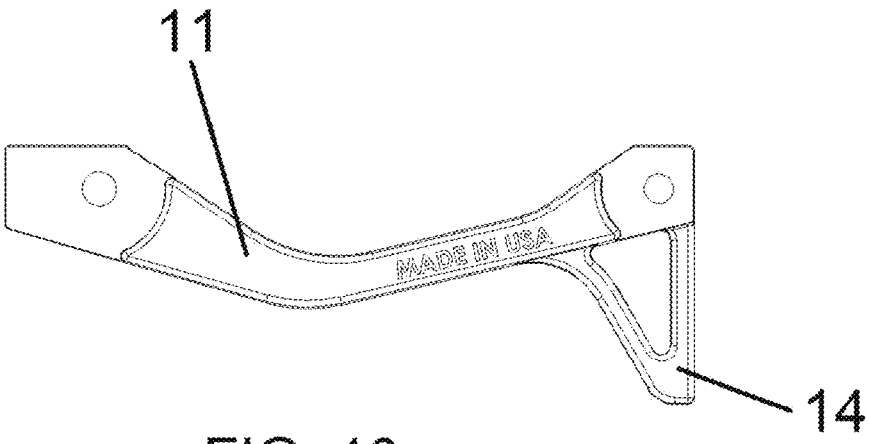
Figure 11C:
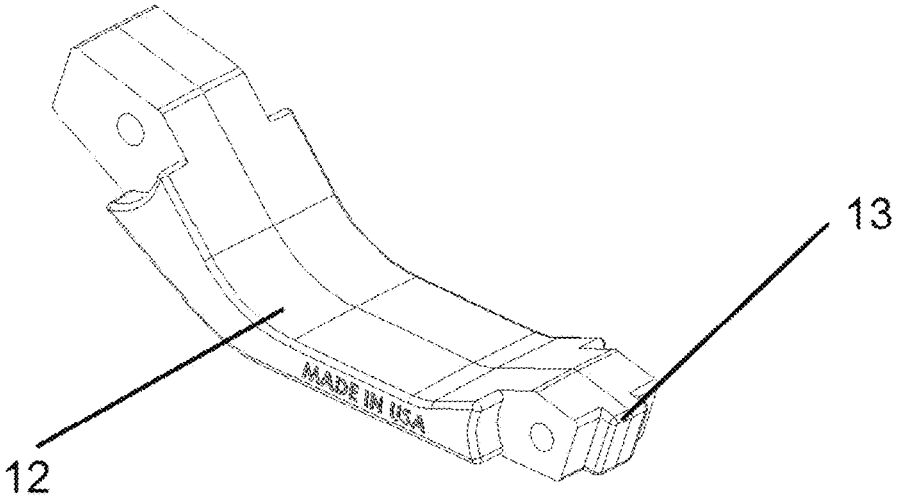
FIGS. 11A. 11B, and 11C depict views of a trigger guard for an AR-platform rifle.
Figure 11B:
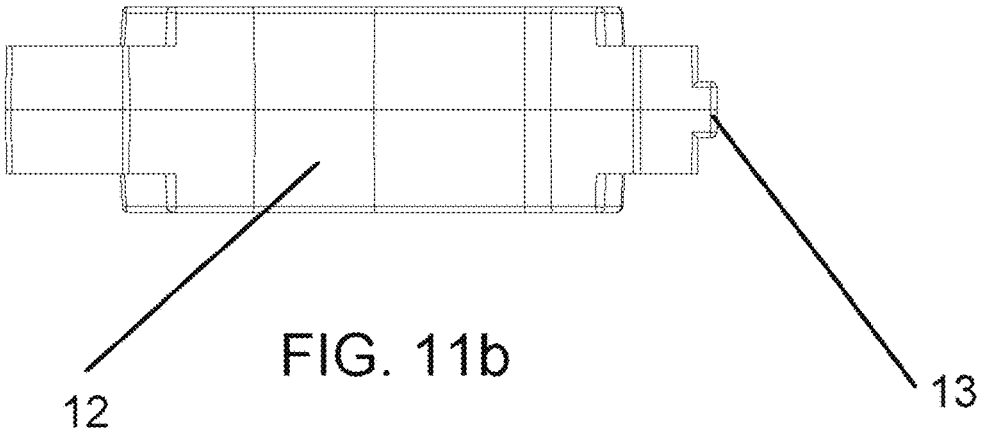
Figure 11A:
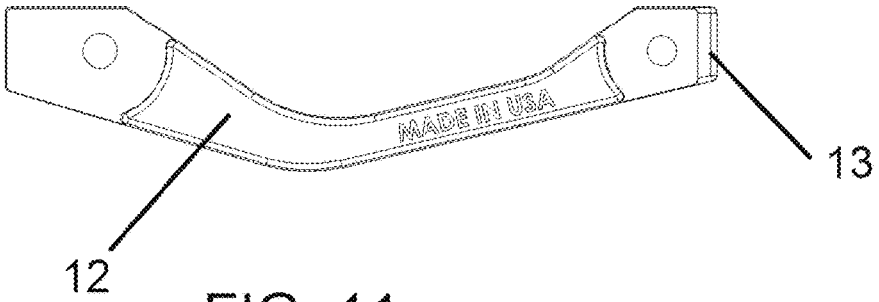
Figure 12D:
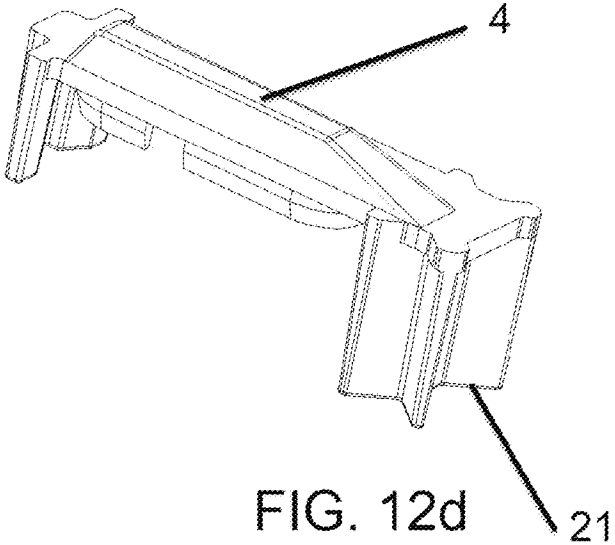
FIGS. 12A, 12B, 12C, and 12D depict views of the magazine's follower.
Figure 12C:
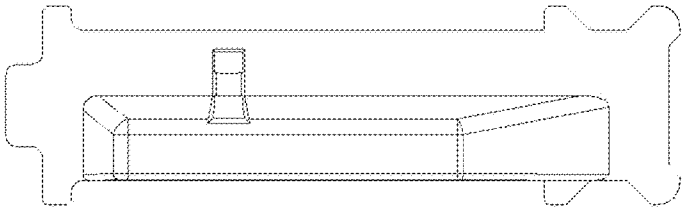
Figure 12B:
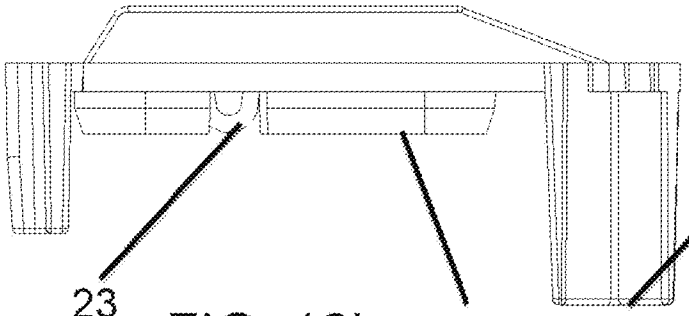
Figure 12A:
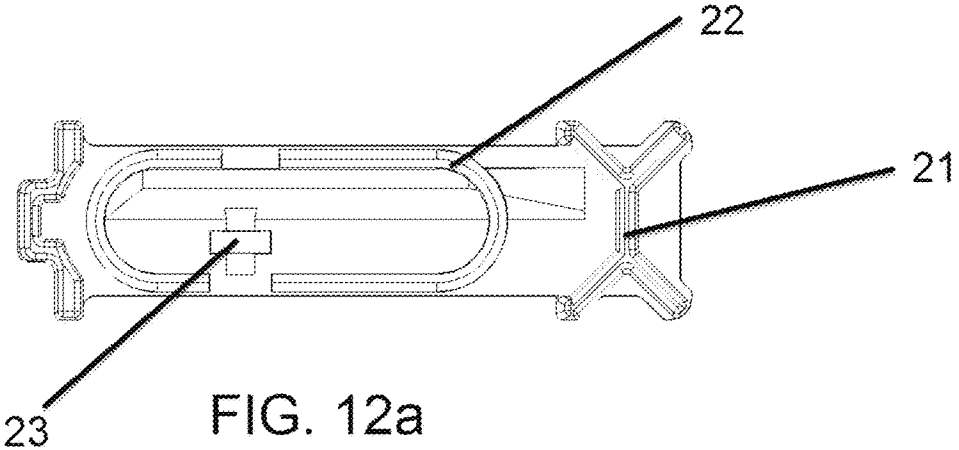
Figure 13B:
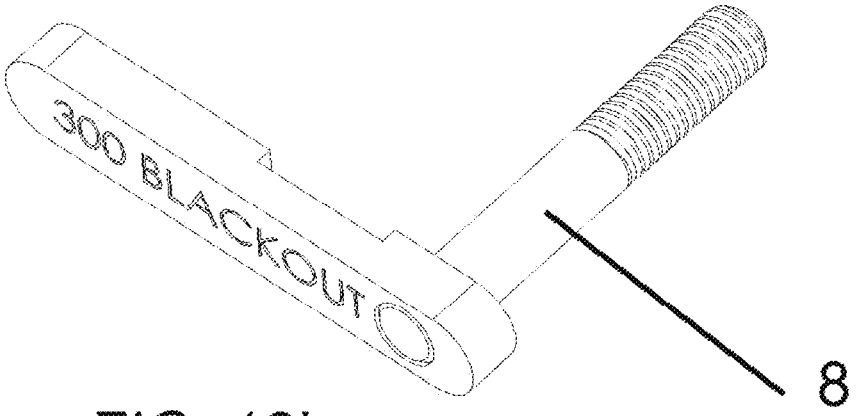
FIGS. 13A and 13B depict close-up views of the magazine retention latch.
Figure 13A:
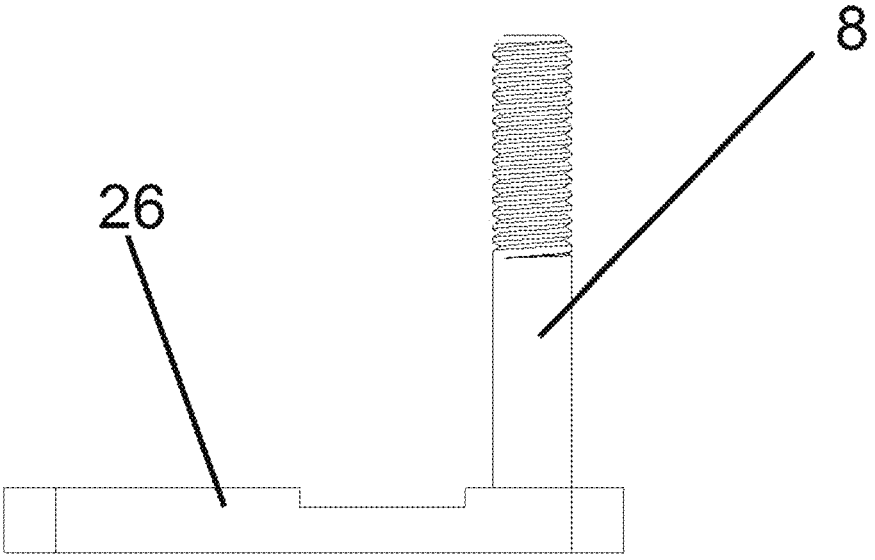

Most firearms companies and magazine makers often encourage the use of the 5.56 labeled and designed magazine use with the 300 ACC Blackout. It's in their manuals and literature. There is an entire industry devoted to continued use of the 5.56/0.223 magazine used for the 300 AAC Blackout. Use of rubber bands, stickers and color-coded things to help identify the use of the 300 AAC Blackout in the 5.56 magazine is a common practice and suggestion by manufacturers. This invention is meant to give a reliable system to stop the confusion, offering the users and manufacturers dependable, reliable, enhanced Caliber Specific magazines that cannot be loaded in any other firearm than the intended firearm with corresponding caliber preventing harm to the firearm and user.

Firearms development has progressed in many ways in the last century. Modern firearms use cartridges consisting of a case, propellant, igniter and projectile. Majority of cartridges are made of metal, the case and the bullet but new technology is emerging with alternative materials. The pursuit of ammunition development relies on previous work and examples. Many cartridges are derived from earlier developments often known as wildcats or hybrids. Two in particular are the 6.5 Creedmoor and the 300 AAC Blackout. 6.5 Creedmoor was derived from the .308 Winchester/7.62×51 NATO cartridge case and the 300 AAC Blackout from the 5.56×45 NATO cartridge case. The 5.56×45 NATO was derived from the 0.223 Remington cartridge case. Most ammunition development is to improve, replace or offer alternative choices to existing ammunition used in firearms. Modern firearms use a means of feeding the ammunition in the action of the firearm, the most popular is the ammunition magazine.

Ammunition magazines are well known in the art of firearms. Their basic construction is a containment shell with two open ends. One end is deemed the "floor" of the magazine and is covered by a plate while the opposite end is the "feed" end and interfaces with the firearm. Inside the volume defined by the shell and plate is a spring and follower assembly. When ammunition is loaded into the magazine, the ammunition pushes the follower down towards the floor and thereby compresses the spring. In use, when one cartridge of ammunition is expended, the compressed spring releases and pushes the follower and associated ammunition upwards toward the feed end and the next round of ammunition is thereby readied. Ammunition magazines have a means of locking into place to provide for proper function in firearms. The placement of the locking points or combination of interactions is particular with slight variations to interface with their host system, the firearm and the ammunition magazine. The corresponding firearm interface system is made of fixed or removable parts or devices used internally or externally to lock a magazine in place are critical to the function, proper loading and feeding of the ammunition magazine. The function of the devices are to load, eject, unload, release, etc. the ammunition magazine from the firearm.

Prior magazines have been manufactured in many different configurations and of different materials. Perhaps the best known in the U.S. are the AR10/SR25 and the AR15/M16/M4 magazines. These magazines function similarly, though they are made with slight variations to interface with their host system. A notable similarity is the magazine release and lock up system is nearly identical regardless of the host system and has been standard device since the first versions of these firearms. Noticeable improvements over the years have been made on the magazine release device to help in the function or ambidextrous use, but the lock up interface has stayed the same without change regardless of the caliber or host system.

The present invention is a polymer magazine with internal guide rails to interface with the internal follower that has improvements for the caliber it is intended. The present invention could be composed of materials other than plastic like steel, aluminum, alloys or any material with the structural strength and ability to conform to the geometry and size externally and internally needed for a particular caliber. This represents a departure from the prior art in that the magazine of the present invention allows for use of alternating forms of the lock up interface with the host system by means of improved shape, cut-outs, protrusions, form, geometry and programmed some models deletion of the former system incorporated in the ammunition magazine to firearm interface.

SUMMARY OF THE DISCLOSURE

In view of the ongoing safety issues and caliber confusion as well as the foregoing disadvantages inherent in the known types of ammunition magazines with the multiple use of varying calibers, this invention provides an improved function, reliability and safety. As such, the present invention's general purpose is to provide a new and improved magazine that is backwards compatible with known weapon platforms and presents the capability to program existing firearms magazine lock up systems by the means of retrofit existing firearms with new magazine release devices that correspond to a magazine designed only to work with that magazine release. The new Magazines also have a programmed delete to bypass the current magazine release shape. Redundant features include the use of alternating trigger guards that are programmed to allow or disallow the use of particular magazines from entering the firearm.

To accomplish these objectives, the improved ammunition magazine comprises improved angularity, internal guide rails, a follower that is configured specifically to correspond to a caliber while maintaining the bolt lock features. By changing the existing lock up system the present invention creates a system of alternating lock-up interfaces particular to a caliber preventing confusion and accidents that can damage the firearm or injure the operator. The magazine also features a polymer construction, outer interface that interacts with certain trigger guards and magazine wells. The magazine incorporates a replaceable floor plate to help with shooting stability and grip.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

I claim:

1. A firearm comprising:

a frame defining a magazine well configured to receive a first magazine type configured to receive a first cartridge caliber and to receive a second magazine type configured to receive a different second cartridge caliber;

a magazine retention latch connected to the frame; and the latch being configured to admit and retain a magazine of the first type and to deny admission and retention of a magazine of the second type.

* * * * *